United States Patent [19]

Wiklund

[11] Patent Number: 4,941,667

[45] Date of Patent: Jul. 17, 1990

[54] GOLF PRACTICING APPARATUS

[75] Inventor: Thomas Wiklund, Trangsund, Sweden

[73] Assignee: Golf Comback AB, Viklung, Sweden

[21] Appl. No.: 375,028

[22] PCT Filed: Sep. 23, 1988

[86] PCT No.: PCT/SE88/00492

§ 371 Date: Jun. 9, 1989

§ 102(e) Date: Jun. 9, 1989

[87] PCT Pub. No.: WO89/04699

PCT Pub. Date: Jun. 1, 1989

[30] Foreign Application Priority Data

Nov. 27, 1987 [SE] Sweden ..... 8704732

[51] Int. Cl.[5] ..... A63B 69/36

[52] U.S. Cl. ..... 273/185 C; 273/200 R

[58] Field of Search ..... 273/200 R, 200 A, 198, 273/197 A, 185 C, 185 R, 184 B, 184 R

[56] References Cited

U.S. PATENT DOCUMENTS

| | | | |
|---|---|---|---|
| 1,566,775 | 12/1925 | Schenk | 273/185 C |
| 3,031,889 | 5/1962 | Magazanik et al. | 273/200 R |
| 3,735,934 | 5/1973 | Black | 273/200 C |

*Primary Examiner*—George J. Marlo

*Attorney, Agent, or Firm*—Kinzer, Plyer, Dorn, McEachran & Jambor

[57] ABSTRACT

Golf practising apparatus comprising a housing (1) having mounted therein a capstan (7) for a line (19, 26) which has a golf ball (27) attached to one end thereof. The housing is provided with a pivotal ground anchorage device (20) and an elongated line guide (23) which includes a guide member (24) embracing the line. The line comprises an outer highly stretchable elastic line part (26) and a further line part of low stretchability. Attached between the two line parts is a stop (25) which is intended to co-act with the guide (24) and prevent the first line part from being wound onto the capstan. The apparatus also includes a brake which applies to the capstan a braking force which increases with increasing lengths of line-paid out from the capstan.

5 Claims, 2 Drawing Sheets

GOLF PRACTICING APPARATUS

The invention relates to golf practising apparatus, comprising a housing which accommodates a rotatable drum or capstan for taking up and paying out a line fastened to the capstan and to which a golf ball can be attached to the free end thereof.

Apparatus for practising tennis strokes are known in which a tennis ball is attached to a rubber cord and the free end of the cord is firmly anchored in some suitable manner, such that when the tennis ball is struck the rubber cord is stretched and tensioned so that the ball will return to the player, enabling a further stroke to be made.

Apparatus of this kind cannot be used for practising golf strokes, mainly because the mass of a golf ball is so large that if the line were permitted to return the golf ball in a manner similar to the aforedescribed tennis ball, the golf ball could cause serious injury and damage to the player and the surrounding respectively, and also due to the fact that the line thicknesses required to ensure that the line will not break when striking a golf ball are of such high values as to cause movement of the ball to deviate excessively from its natural movement.

Accordingly, it is a main object of the invention to provide apparatus of the aforedescribed kind which incorporates a thin line and which enables the ball to be returned without risk of injury or damage.

Figure 1:
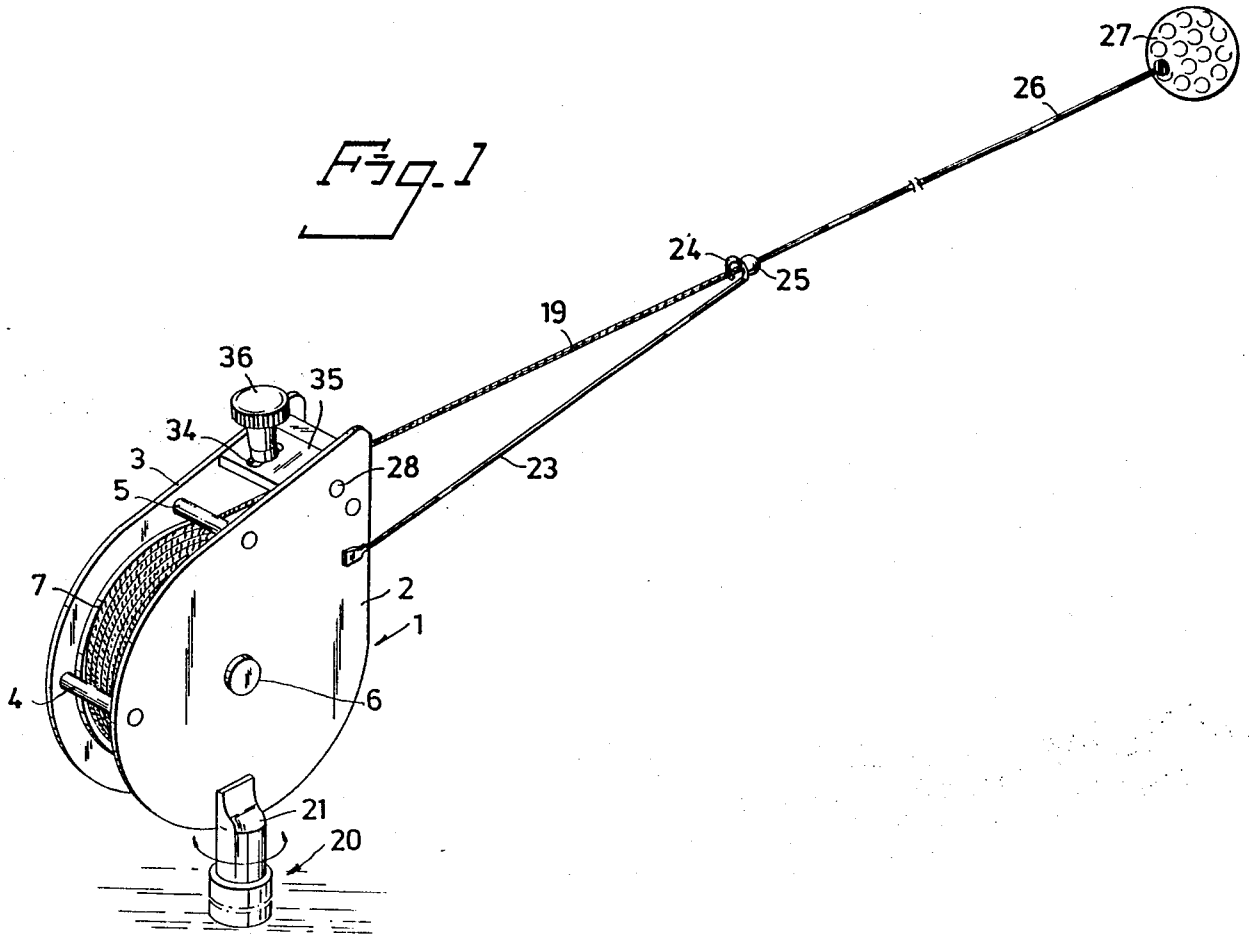
Figure 2:
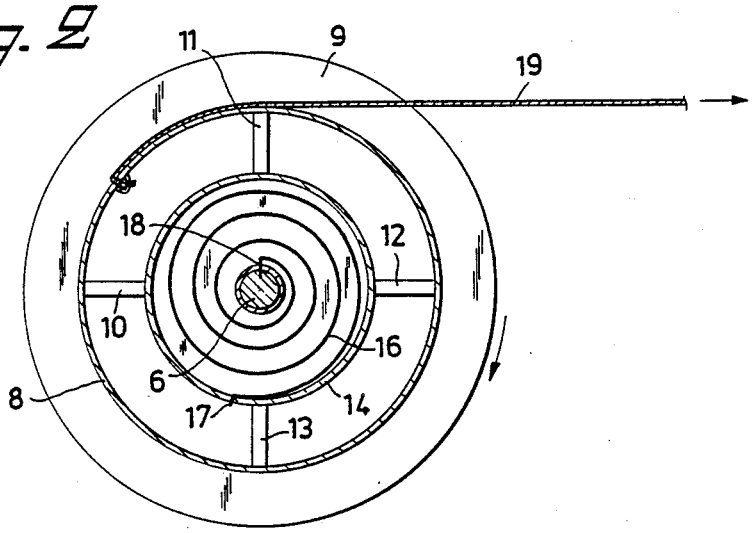

This main object is fully achieved by means of the invention defined in the following claims and described hereinafter with reference to an exemplifying embodiment thereof illustrated in the accompanying drawings, in which FIG. 1 illustrates one embodiment of the invention; FIG. 2 illustrates a line catch arrangement; and FIG. 3 illustrates the capstan provided with a brake and return spring.

The embodiment of the invention illustrated in FIG. 1 includes a housing 1 which comprises two mutually identical and mutually parallel side members 2, 3 which are made of metal or some other mechanically strong material, such as glass-fibre reinforced plastic, and which are connected together by means of cross-ties 4, 5 or similar spacing devices. A line drum or capstan 7 is mounted on a stationary central shaft 6 extending between the side members 2, 3. As will best be seen from FIG. 2, the capstan 7 comprises a cylinder 8 having peripheral flanges 9 (only one such flange being shown in FIG. 2). Mounted concentrically in the cylinder 8, with the aid of ties 10, 11, 12, 13, is a brake drum 14 provided with end walls, e.g. the end wall 15 shown in FIG. 2, in which the stationary or fixed shaft 6 is mounted. The brake drum 14 of the illustrated embodiment has fitted thereto a helical spring, or coil spring, 16 whose one end 17 is attached to the drum 14 and the other end 18 of which is attached to the shaft 16. The arrangement is such that when the line 19 is unwound from the drum 7, the spring 16 is tensioned and exerts a progressively increasing braking force on the drum 7. The spring 16 is preferably dimensioned so that it will function as a return spring subsequent to the line 19 having been partially or fully unwound from the drum 7, so that the line will be wound automatically back onto the drum. The line 19 preferably has a length of 30 meters and is substantially non-stretchable or, in all events, only slightly stretchable, and consists, e.g., of a plaited line having a diameter of 1.5 -2 mm. As illustrated in FIG. 1, the housing 1 is provided with an anchorage 20 by means of which the apparatus can be anchored to the ground, said anchorage in the illustrated case having the form of a rod whose upper end part 21 is firmly connected to the side member 2. The free end-part of the rod is mounted for free rotation in a pipe or tube 22, which can be driven substantially vertically into the ground. The housing 1 is therewith able to swing freely around a vertical axis. Mounted on the side member 2 is an elongated line guide 23 which is made of spring steel or some other suitable material and which carries on its free end a ring, eye or some other guide means 24 which embraces the line 19 and permits said line to pass freely therethrough. Attached to the end of the line 19 located externally of the guide device 24 is a stop member 25 which in the illustrated case has the form of a ball which is unable to pass through the opening in the guide device. The stop member 25 is also connected to a thin line 26 made of a highly stretchable elastic material, for example a line made of natural rubber, this outer line being much shorter than the line 19, and having a length of, e.g., 2–3 meters.

When the helical spring 16 is dimensioned to return the golf ball 27 attached to the outer end of the line 19 to the position from which the ball was driven, it may be desired to prevent the golf ball from being returned, and consequently the illustrated apparatus is also provided with a locking device. An exemplifying embodiment of such a locking device is illustrated in FIGS. 1 and 3. Thus, a locking arm 29 is arranged for free pivotal movement on a shaft 28 extending between the side members 2 and 3. One end of the locking arm 29 is journalled on the shaft 28 and consequently, when the apparatus is operative and the line 19 runs out in the manner illustrated in FIG. 1, the locking arm will tend to swing anticlockwise in FIG. 3 to the position shown in full lines, in which a locking hook 30 lies against the outwardly running line 19 and presses the line lightly against an anvil surface 31. The braking force exerted on the line 19 is quite negligible. When the spring 16 begins to return the line, the locking hook will engage the line and cause the locking arm 29 to swing in a clockwise direction, so that the right-hand edge part 32 of the arm, as seen in FIG. 3, clamps the line firmly against the anvil and therewith prevents further winding of the line 19 onto the capstan 7.

Figure 3:
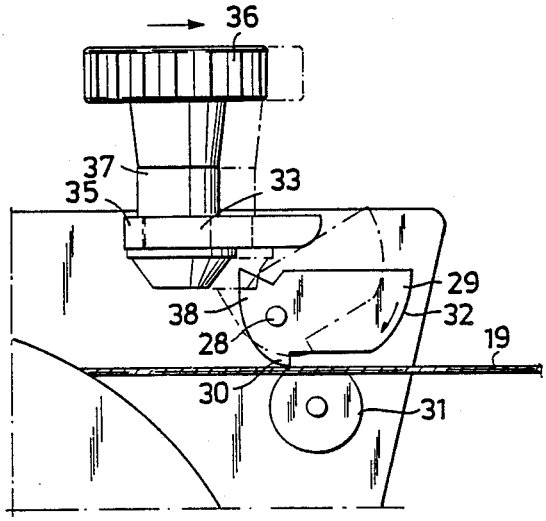

If, on the other hand, it is desired that the golf ball will always be returned to the location from which it was struck, the locking device is released, by moving a locking pin 33 having a conical lower end axially in a groove 34 (FIG. 1) provided in a support plate 35 arranged between the side members to the position shown in broken lines in FIG. 3, whereafter the conical end of said locking pin is moved downwardly by turning the pin 33 with the aid of a knob 36. The locking pin 33 is screwed into a nut 37 firmly connected to the support plate 34. The conical end of the locking pin engages with an abutment 38 and swings the locking arm 29 to the position shown in broken lines, in which the locking arm is out of contact with the line 19.

When using the described apparatus, the golf ball is placed on the ground and the line 19 wound fully onto the capstan 7. When the golf ball is struck it is assumed that the ball will travel obliquely relative to the line guide 23. The line guide will rotate the housing 1, at the same time as the elastic line 26 is placed under tension, such that the line guide points in the direction of the ball. The large force acting on the elastic line 26 when the ball is struck causes the line 26 to stretch and absorb the abrupt jerk that occurs, while said force is successively applied to the non-stretchable line 19, such that the capstan 7 will rotate in an acceptable fashion and excessive feed of the line from the capstan is prevented by the braking force exerted by the helical spring 16, this force increasing progressively as the line 19 runs off the capstan 7. When the line has reached the ground, which according to the aforegoing implies that the golf ball has been driven a distance of about 15–20 meters, the line, together with the golf ball, can be drawn back to the place from which the golf ball was driven and wound onto the capstan, it being assumed in this case that the spring 16 functions as a line return spring, although it will be understood that the capstan 7 can be turned manually by means of devices not shown. When using the illustrated apparatus, there is no danger of the golf ball being slung back and injuring the player or causing damage to the surroundings, and the provision of the progressive braking device, which in the illustrated embodiment comprises the spring 16, and the stretchable short line 26 eliminates all risk of the capstan rotating too rapidly and therewith tangling the line 19. The most important function of the stop device 24 is that of preventing the stretchable, short line 26 from being wound onto the capstan 7 and, in a stretched state, forming mutually locking turns which can cause damage to the line when attempting to loosen the same.

I claim:

1. Golf practising apparatus comprising a housing (1) having rotatably mounted therein a capstan (7) for taking up and paying out a line (19, 26) which is firmly connected to the capstan and which has a golf ball (27) connected to the free end thereof, characterized in that the housing is provided with a ground anchoring device (20) which permits the housing (1) to be rotated about a substantially vertical axis; in that extending outwardly from the housing is an elongated, resilient line guide (23) having provided on the end thereof remote from the housing a guide device (24) which freely embraces the line; in that the line comprises a first, outer highly stretchable elastic line part (26) and a second line part (19) of low stretchability and connected to the capstan; and in that attached between the first and the second line parts is a stop device (25) which is intended to co-act with the guide device (24) when line is wound onto the capstan in a manner to prevent the first line part (26) from being wound onto the capstan (7); and in that a brake means (16) is configured to exert on the capstan (7) a braking force which increases with increasing lengths of line paid out from the capstan.

2. Apparatus according to claim 1, characterized in that the braking means comprises a helical spring (16) which is connected to the capstan (7) and constructed to be tensioned progressively during rotation of the capstan when line is unwound therefrom.

3. Apparatus according to claim 2, characterized in that the helical spring (16) is dimensioned so that when the spring is tensioned it will exert on the capstan (7) a force of such magnitude as to cause line unwound from the capstan to be rewound thereonto.

4. Apparatus according to claim 2, characterized by manually adjustable line-locking means (29, 33) which in one first position of adjustment are effective in permitting line to be freely unwound from and wound onto the capstan, and in a second position of adjustment are operative in preventing line from being wound onto the capstan (7) under the influence of the helical spring.

5. Apparatus according to claim 1, characterized by manually adjustable line-locking means (29, 33) which in one first position of adjustment are effective in permitting line to be freely unwound from and wound onto the capstan, and in a second position of adjustment are operative in preventing line from being wound onto the capstan (7) under the influence of the helical spring.

* * * * *